US007530801B2

(12) United States Patent
Hicks

(10) Patent No.: US 7,530,801 B2
(45) Date of Patent: May 12, 2009

(54) BI-DIRECTIONAL DISC-VALVE MOTOR AND IMPROVED VALVE-SEATING MECHANISM THEREFOR

(75) Inventor: Aaron M. Hicks, Fridley, MN (US)

(73) Assignee: Eaton Corporation, Cleveland, OH (US)

( * ) Notice: Subject to any disclaimer, the term of this patent is extended or adjusted under 35 U.S.C. 154(b) by 228 days.

(21) Appl. No.: 11/453,490

(22) Filed: Jun. 15, 2006

(65) Prior Publication Data

US 2007/0292296 A1 Dec. 20, 2007

(51) Int. Cl.
*F03C 2/00* (2006.01)
*F01C 1/02* (2006.01)

(52) U.S. Cl. ..... 418/61.3; 418/102; 418/186; 137/625.21; 251/175; 251/186

(58) Field of Classification Search ..... 418/61.3, 418/171, 166, 102, 270, 133, 186; 137/625.21; 251/175, 286
See application file for complete search history.

(56) References Cited

U.S. PATENT DOCUMENTS 3,572,983 A 3/1971 McDermott
4,390,329 A 6/1983 Thorson
4,940,401 A * 7/1990 White, Jr. ..... 418/61.3
6,086,345 A 7/2000 Acharya et al.
6,739,849 B1 5/2004 Hansen et al.

FOREIGN PATENT DOCUMENTS

DE 10008732 C1 * 12/2001
WO WO 03064858 A1 * 10/2003

* cited by examiner

*Primary Examiner*—Theresa Trieu
(74) *Attorney, Agent, or Firm*—Sonu N. Weaver

(57) ABSTRACT

A rotary fluid pressure device (11) has a stationary valve member (17), a rotatable valve member (51), and a valve seating mechanism (73). The valve seating mechanism (73) defines an outer balance ring member (75) having a valve-confronting surface (79) in engagement with an opposite surface (81) of the rotatable valve member (51) and an inner balance ring member (77) having a valve-confronting surface (111) in engagement with the opposite surface (81) of the rotatable valve member (51), with the outer balance ring member (75) and the inner balance ring member (77) being structurally independent from the other. The outer balance ring member (75) and the inner balance ring member (77) define a balance ring passage (71) which provides continuous fluid communication between a fluid inlet (53) or a fluid outlet (53) and the valve passages (61) in the rotatable valve member (51).

13 Claims, 10 Drawing Sheets

BI-DIRECTIONAL DISC-VALVE MOTOR AND IMPROVED VALVE-SEATING MECHANISM THEREFOR

BACKGROUND OF THE DISCLOSURE

The present invention relates to a bi-directional fluid pressure-operated displacement unit, of the type including a rotary valve member, and more particularly, to an improved valve-seating mechanism for use therein.

Although the present invention may be used in various pump and motor configurations in which fluid flows axially through a valve member and contact must be maintained between the valve member and a corresponding port plate which communicates with the volume chambers of a fluid displacement mechanism, it is especially advantageous when used in disc-valve gerotor motors. Therefore, the present invention will be discussed in connection with disc-valve gerotor motors without intending to limit the scope of the invention.

Fluid motors of the type utilizing a gerotor displacement mechanism to convert fluid pressure into a rotary output are widely used in a variety of low speed, high torque commercial applications. Typically, in fluid motors of this type, the gerotor mechanism includes a fixed internally toothed member (ring) and an externally toothed member (star) which is eccentrically disposed within the ring and orbits and rotates relative thereto. In fluid motors of this type there are normally two relatively moveable valve members. One of the valve members is stationary and provides a plurality of fluid passages, each one being in permanent communication with one of the volume chambers defined by the gerotor mechanism, while the other valve member rotates relative to the stationary valve member, in commutating fluid communication therewith, as is now well known to those skilled in the low speed, high torque gerotor motor art.

Low speed, high torque gerotor motors are illustrated in U.S. Pat. Nos. 3,572,983 and 4,390,329, both of which are assigned to the assignee of the present invention and incorporated herein by reference. Fluid motors made in accordance with the cited patents include, in addition to the previously mentioned stationary valve member and rotatable disc-valve member, a valve-seating mechanism which is now also generally well known in the gerotor motor art. The general function of the valve-seating mechanism is to exert a circumferentially uniform biasing force, biasing the rotatable valve member into sliding, sealing engagement with the stationary valve member.

One of the problems with fluid motors of the disc-valve type is a condition referred to as "internal leakage." Internal leakage is defined as a volume of fluid communicated between the high-pressure side and the low-pressure side that effectively bypasses the gerotor displacement mechanism. Since such internal leakage effectively bypasses the gerotor displacement mechanism, such leakage reduces the volumetric efficiency of the fluid motor. As is well known to those skilled in the art, internal leakage in a fluid motor varies proportionally to the operating pressure of the fluid. Therefore, as the operating pressure of the inlet fluid increases, the internal leakage in the fluid motor also increases.

A recent trend in commercial applications which use fluid motors of the disc-valve type is to require increased operating pressure ratings in the fluid motor. In addition to this requirement, the manufacturers of commercial products for those applications have requested improved volumetric efficiencies at these higher operating pressures. However, as previously stated, higher operating pressures result in more internal leakage in the fluid motor and lower volumetric efficiencies. Therefore, in order to meet these requests and requirements, it is necessary to identify, and reduce the effect of any sources of volumetric inefficiency in the fluid motor.

One location in fluid motors of the disc-valve type where internal leakage is prevalent, especially at high operating fluid pressures, is at the interface between the rotatable valve member and the valve-seating mechanism. At this location, fluid inlet, fluid outlet, and case fluid pressure forces act on the valve-confronting surface of the valve-seating mechanism and cause the valve-seating mechanism to "distort"(or deform or deflect). Such distortion, is referred to by those skilled in the art as "potato chipping." Potato chipping occurs when the outer periphery of the valve-seating mechanism distorts, deforms or deflects more or less than the inner diameter of the valve-seating mechanism, such that the valve-confronting surface and the adjacent surface of the stationary valve member are no longer in a planar, face-to-face relationship. Distortion of the valve-seating mechanism results in a loss of sealing engagement between the valve-seating mechanism and the rotatable valve member. Internal leakage occurs at the location of this loss of sealing engagement. At higher operating pressures, this distortion, deformation or deflection is more pronounced.

In the disc-valve fluid motor art, there are two primary types of rotatable valve members. The first type is referred to as a "blind-bore" type. In the blind-bore type of disc-valve, as illustrated in the above incorporated U.S. Pat. Nos. 3,572,983 and 4,390,329, the internal cavity, in which internal splines are formed, of the rotatable valve member does not continue along the entire axial length of the valve member, and thus, fluid cannot flow axially throughout the axial length of the valve. The second type is referred to as a "thru-bore" type. In the thru-bore type of disc-valve, an internal bore, in which internal splines are formed, extends the entire axial length of the rotatable valve member. While the present invention can be used with both types of rotatable valve members, it is especially advantageous when used with a motor of the thru-bore type, and will be described in connection therewith, without intending to limit the scope of the invention.

BRIEF SUMMARY OF THE INVENTION

Accordingly, it is an object of the present invention to provide an improved valve-seating mechanism for a bi-directional disc-valve motor that overcomes the above discussed disadvantages of the prior art.

It is a more specific object of the present invention to provide an improved valve-seating mechanism for a bi-directional disc-valve motor that achieves less internal leakage than the prior art mechanism at high pressure.

The above and other objects of the invention are accomplished by the provision of an improved rotary fluid pressure device of the type including a housing that defines a fluid inlet and a fluid outlet, a displacement mechanism that defines expanding and contracting fluid volume chambers, a stationary valve member that defines fluid passages in fluid communication with the expanding and contracting volume chambers in the displacement mechanism, a rotatable valve member that defines valve passages that communicate between the fluid inlet and fluid outlet and the fluid passages in the stationary valve member, a valve surface of the rotatable valve member being in sliding, sealing engagement with the valve surface of the stationary valve member, and the rotatable valve member further having an opposite surface.

The improved rotary fluid pressure device is characterized by an outer balance ring member having a valve-confronting surface in engagement with the opposite surface of the rotatable valve member, an inner balance ring member having a valve-confronting surface in engagement with the opposite surface of the rotatable valve member, with the outer balance ring member and the inner balance ring member defining a balance ring passage which provides continuous fluid communication between the fluid inlet or the fluid outlet and the valve passages in the rotatable valve member.

DETAILED DESCRIPTION OF THE PREFERRED EMBODIMENT

Figure 1:
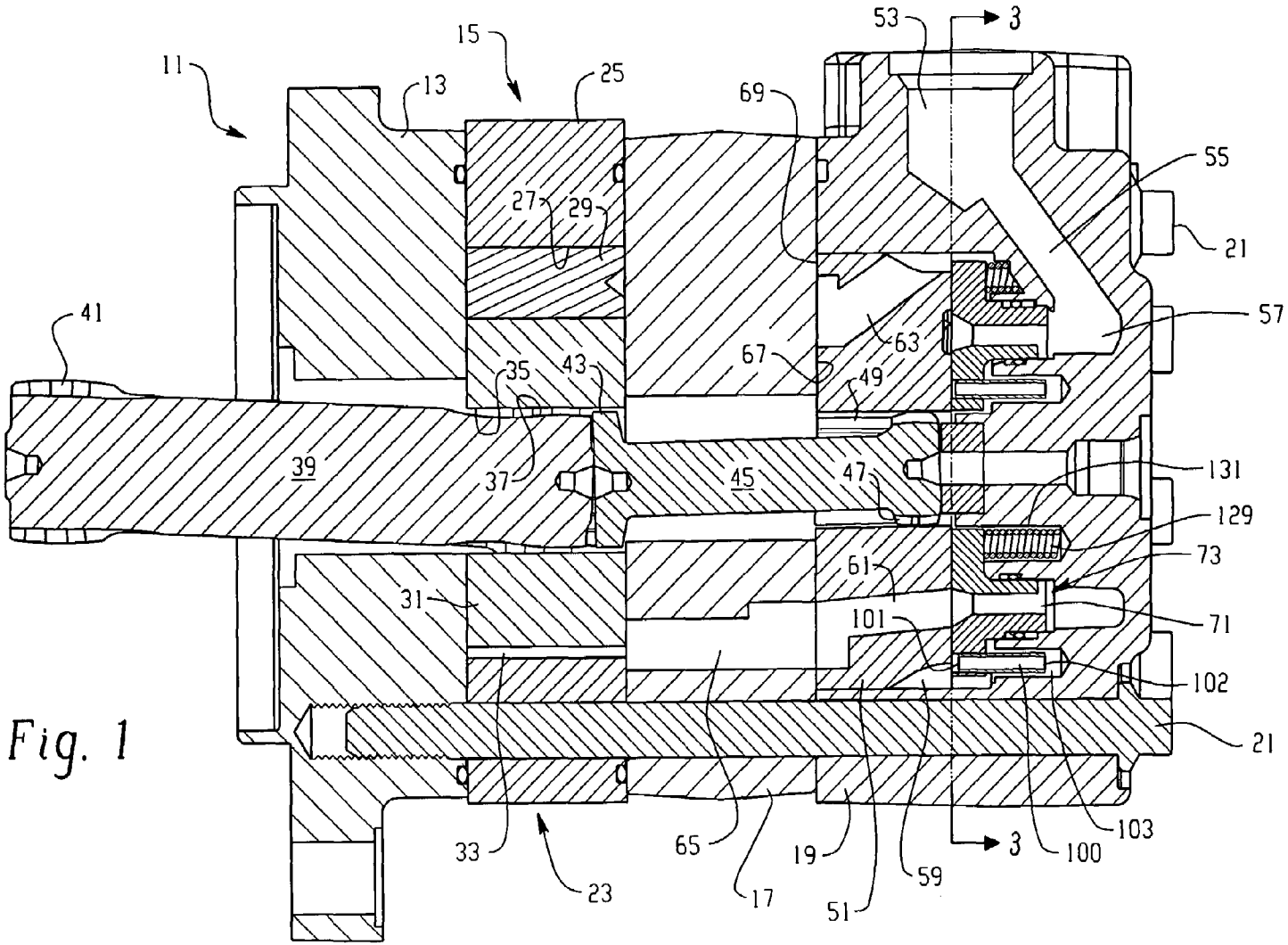
FIG. 1 is an axial cross-section of a bi-directional disc-valve motor made in accordance with the present invention and includes a fragmentary section taken on a different plane.

Referring now to the drawings, which are not intended to limit the invention, FIG. 1 is an axial cross-section of a bi-directional disc-valve motor of the thru-bore type made in accordance with the present invention. The disc-valve motor, generally designated 11, includes a mounting plate 13, a gerotor displacement mechanism 15, a stationary valve member 17, also referred to hereinafter as the "port plate", and a valve housing 19. The sections are held together in tight sealing engagement by means of a plurality of bolts 21, in threaded engagement with the mounting plate 13.

The gerotor displacement mechanism 15 is well known in the art and will therefore be described only briefly herein. More specifically, in the subject embodiment, the gerotor displacement mechanism 15 is a Geroler® displacement mechanism comprising an internally toothed assembly 23. The internally toothed assembly 23 comprises a stationary ring member 25 which defines a plurality of generally semi-cylindrical openings 27. Rotatably disposed within each of the semi-cylindrical openings 27 is a cylindrical member 29, as is now well known in the art. Eccentrically disposed within the internally toothed assembly 23 is an externally toothed rotor member 31, typically having one less external tooth than the number of cylindrical members 29, thus permitting the externally toothed rotor member 31 to orbit and rotate relative to the internally toothed assembly 23. The relative orbital and rotational movement between the internally toothed assembly 23 and the externally toothed rotor member 31 defines a plurality of expanding and contracting volume chambers 33. The externally toothed rotor member 31 defines a set of internal splines 35 formed at the inside diameter of the rotor member 31. The internal splines 35 of the rotor member 31 are in engagement with a set of external, crowned splines 37 on a main drive shaft 39. Disposed at the opposite end of the main drive shaft 39 is another set of external, crowned splines 41, for engagement with a set of internal splines (not shown) in a customer-supplied output device, such as a shaft (not shown).

Also in engagement with the internal splines 35 of the externally toothed rotor member 31 is a set of external splines 43 formed about one end of a valve drive shaft 45 which has, at its opposite end, another set of external splines 47 in engagement with a set of internal splines 49 formed about the inner periphery of a rotatable valve member 51. The valve member 51 is rotatably disposed within the valve housing 19, and the valve drive shaft 45 is splined to both the externally toothed rotor member 31 and the rotatable valve member 51 in order to maintain proper valve timing, as is generally well known in the art.

The valve housing 19 defines a fluid port 53 which is in open fluid communication with a fluid passage 55. The fluid passage 55 is in open fluid communication with an annular fluid chamber 57. The valve housing 19 further defines a second fluid port (not shown) which is in open communication with a second fluid passage (not shown). The second fluid passage is in open fluid communication with an annular valve housing cavity 59, which is cooperatively defined by an inner annular surface of the valve housing 19 and the rotatable valve member 51.

The rotatable valve member 51 defines a plurality of alternating valve passages 61 and 63. The valve passages 61, which are disposed in an annular fluid groove 64, are in continuous fluid communication with the annular fluid chamber 57 in the valve housing 19, while the valve passages 63 are in continuous fluid communication with the valve housing cavity 59. In the subject embodiment, and by way of example only, there are eight of the valve passages 61, and eight of the valve passages 63, corresponding to the eight external teeth or lobes on the externally toothed rotor member 31.

Referring still to FIG. 1, the port plate 17 defines a plurality of fluid passages 65, each of which is disposed to be in continuous fluid communication with the adjacent volume chamber 33. The port plate 17 also defines a transverse valve surface 67, and the rotatable valve member 51 defines a transverse valve surface 69 in sliding, sealing engagement with the valve surface 67. In operation, pressurized fluid entering the fluid port 53 will flow through the fluid passage 55 and into the annular fluid chamber 57. The pressurized fluid will then flow through a fluid passage 71, in a valve-seating mechanism, generally designated 73, both of which will also be described in greater detail subsequently. Fluid will then flow into the valve passages 61 in the rotatable valve member 51. The pressurized fluid will then flow through the valve passages 61 in the rotatable valve member 51 which are in commutating fluid communication with the fluid passages 65 in the port plate 17. The pressurized fluid will enter the expanding volume chambers 33 in the gerotor displacement mechanism 15 through the adjacent fluid passages 65 in the port plate 17 which are in commutating fluid communication with the respective valve passages 61. As is well known to those skilled in the art, the above described flow will result in orbital and rotational movement of the externally toothed rotor member 31.

Exhaust fluid will flow from the contracting volume chambers 33 through the adjacent fluid passages 65 in the port plate 17 which are in commutating fluid communication with the valve passages 63 in the rotatable valve member 51 and into those respective valve passages 63. The fluid will then flow into the valve housing cavity 59 and to a reservoir (not shown) through the second fluid passage (not shown) and the second fluid port (not shown) in the valve housing 19.

Figure 2:
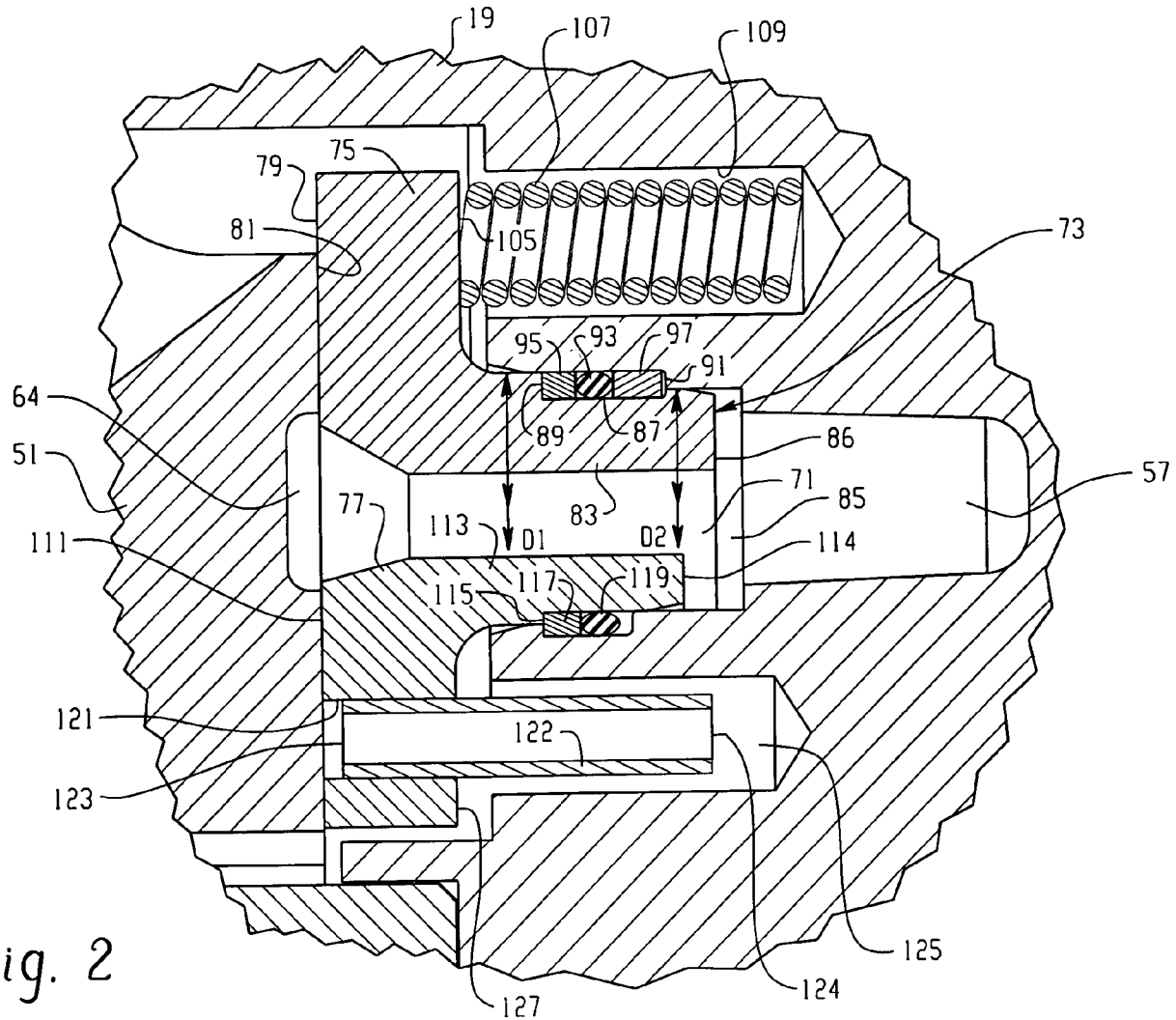
FIG. 2 is an enlarged, fragmentary, axial cross-section of an embodiment of a valve-seating mechanism, in accordance with the present invention, as shown in FIG. 1.
Figure 3:
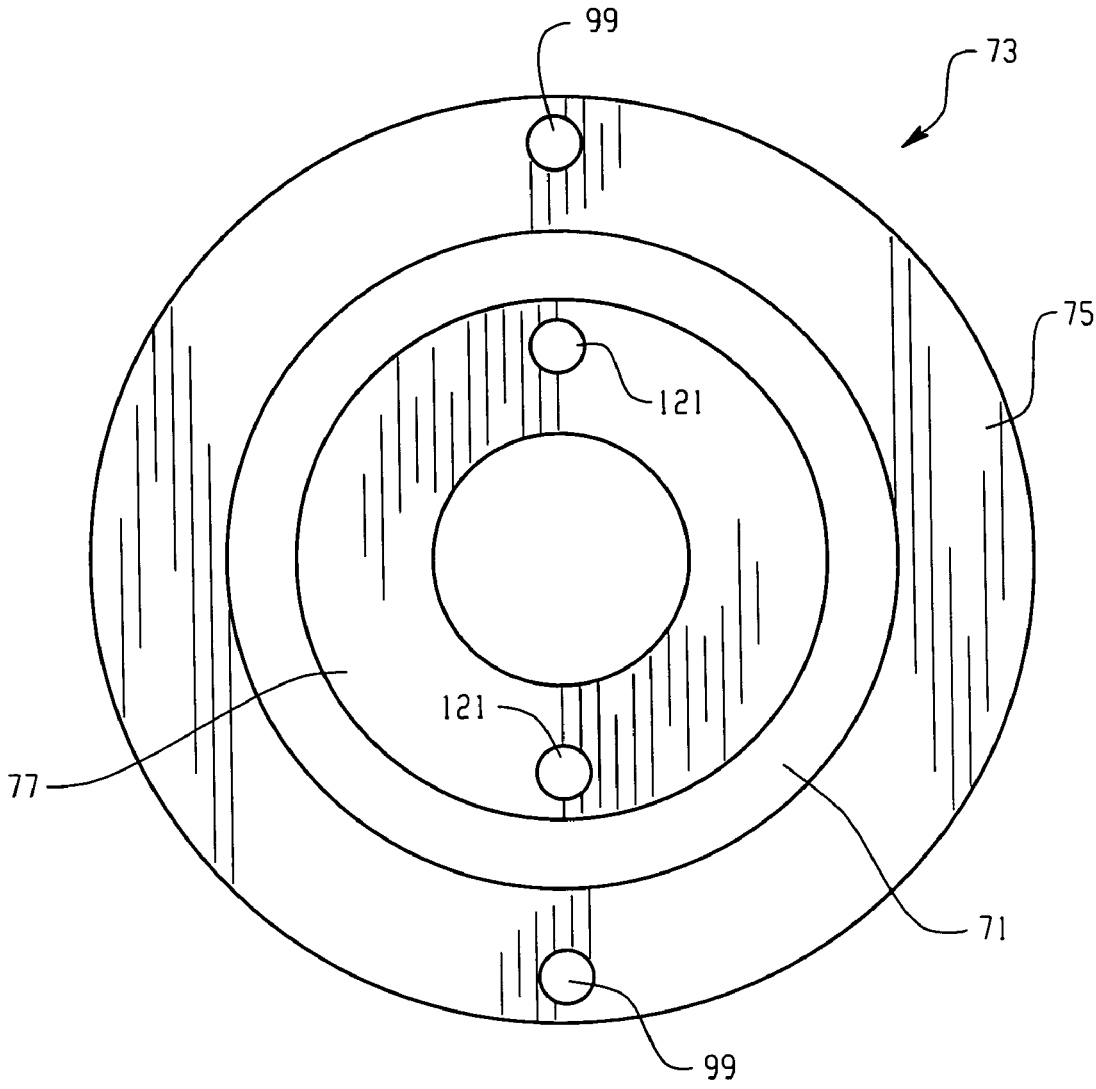
FIG. 3 is a transverse cross-section, taken on line 3-3 of FIG. 1, but showing only the valve-seating mechanism.

Referring now to FIGS. 2 and 3, with reference made to elements introduced in FIG. 1, the valve-seating mechanism 73 includes an outer balance ring member 75 and an inner balance ring member 77, each of which is structurally independent from the other. The outer balance ring member 75 defines a valve confronting surface 79 which is in sealing engagement with a rearward surface 81 of the rotatable valve member 51. The outer balance ring member 75 also defines a rearwardly projecting, integral ring portion 83 which is disposed in a mating annular ring groove 85 in the valve housing 19. The outer balance ring member further defines an axial end surface 86.

The rearwardly projecting, integral ring portion 83 of the outer balance ring member 75 defines a circumferential annular groove 87 with a first axial end 89 and a second axial end 91. The outer diameter D1 of the first axial end 89 of the circumferential annular groove 87 is larger than the outer diameter D2 of the second axial end 91 of the circumferential annular groove 87. The difference between the outer diameter D1 of the first axial end 89 and the outer diameter D2 of the second axial end 91 is determined from the amount of axial balancing force required to maintain sealing engagement between the transverse valve surface 69 of the rotatable valve member 51 and the transverse valve surface 67 of the port plate 17. A sealing member 93 and first and second backup members 95, 97, respectively, are disposed in the circumferential annular groove 87 of the outer balance ring member 75 such that the sealing member 93 is located between the first and second back-up members 95, 97.

The outer balance ring member 75 of the valve-seating mechanism 73 further defines a plurality of rotational constraint holes 99 (see FIG. 3), and each of the constraint holes 99 has associated therewith a pin member 100 (shown only in FIG. 1) including a first axial end 101 and a second axial end 102. The second axial ends 102 are disposed in a plurality of rotational constraint holes 103 defined by the valve housing 19. The pin members 100 are disposed in the rotation constraint holes 99 of the outer balance ring member 75 and the rotational constraint holes 103 in the valve housing 19 in order to prevent rotation of the outer balance ring member 75 with respect to the valve housing 19.

The outer balance ring member 75 of the valve-seating mechanism 73 further defines a spring confronting surface 105 which is in engagement with a plurality of biasing springs 107. The biasing springs 107 are disposed in a plurality of biasing spring holes 109 in the valve housing 19. In the absence of pressurized fluid, the biasing springs 107 maintain the engagement of the valve surface 67 of the port plate 17 and the valve surface 69 of the rotatable valve member 51 as well as the valve confronting surface 79 of the outer balance ring member 75 and the rearward surface 81 of the rotatable valve member 51.

Referring still primarily to FIGS. 2 and 3, the inner balance ring member 77 of the valve-seating mechanism 73 defines a valve confronting surface 111 which is seated against the rearward surface 81 of the rotatable valve member 51. The inner balance ring member 77 defines a rearwardly projecting, integral ring portion 113 which is disposed in the annular ring groove 85 in the valve housing 19. The inner balance ring member 77 further defines an axial end surface 114. The rearwardly projecting, integral ring portion 113 defines a circumferential step 115, against which is disposed a backup member 117 and a sealing member 119.

Similar to the outer balance ring member 75, the inner balance ring member 77 of the valve-seating mechanism 73 defines a plurality of rotational constraint holes 121, each of the constraint holes 121 has associated therewith a pin member 122 including a first axial end 123 and a second axial end 124. The second axial ends 124 are disposed in a plurality of rotational constraint holes 125 defined by the valve housing 19. The pin members 122 are disposed in the rotational constraint holes 121 in the inner balance ring member 77 and the rotational constraint holes 125 in the valve housing 99 in order to prevent any rotation of the inner balance ring member 77 with respect to the valve housing 19.

The inner balance ring member 77 defines a spring confronting surface 127 which is in engagement with a plurality of biasing springs 129 (shown only in FIG. 1). The biasing springs 129 are disposed in a plurality of biasing spring holes 131 (shown in FIG. 1) in the valve housing 19. In the absence of pressurized fluid, the biasing springs 129 maintain the engagement of the valve surface 67 of the port plate 17 and the valve surface 69 of the rotatable valve member 51, as well as the valve confronting surface 111 of the inner balance ring member 77 and the rearward surface 81 of the rotatable valve member 51.

Referring still to FIG. 2 and FIG. 3, the inner balance ring member 77 is radially positioned with respect to the outer balance ring member 75 such that the inner balance ring member 77 is concentric or nearly concentric to the outer balance ring member 75. The fluid passage 71 is formed between the outer diameter of the inner balance ring 77 and the inner diameter of the outer balance ring 75, and therefore, comprises an annular fluid passage, providing relatively little restriction to flow.

Figure 4:
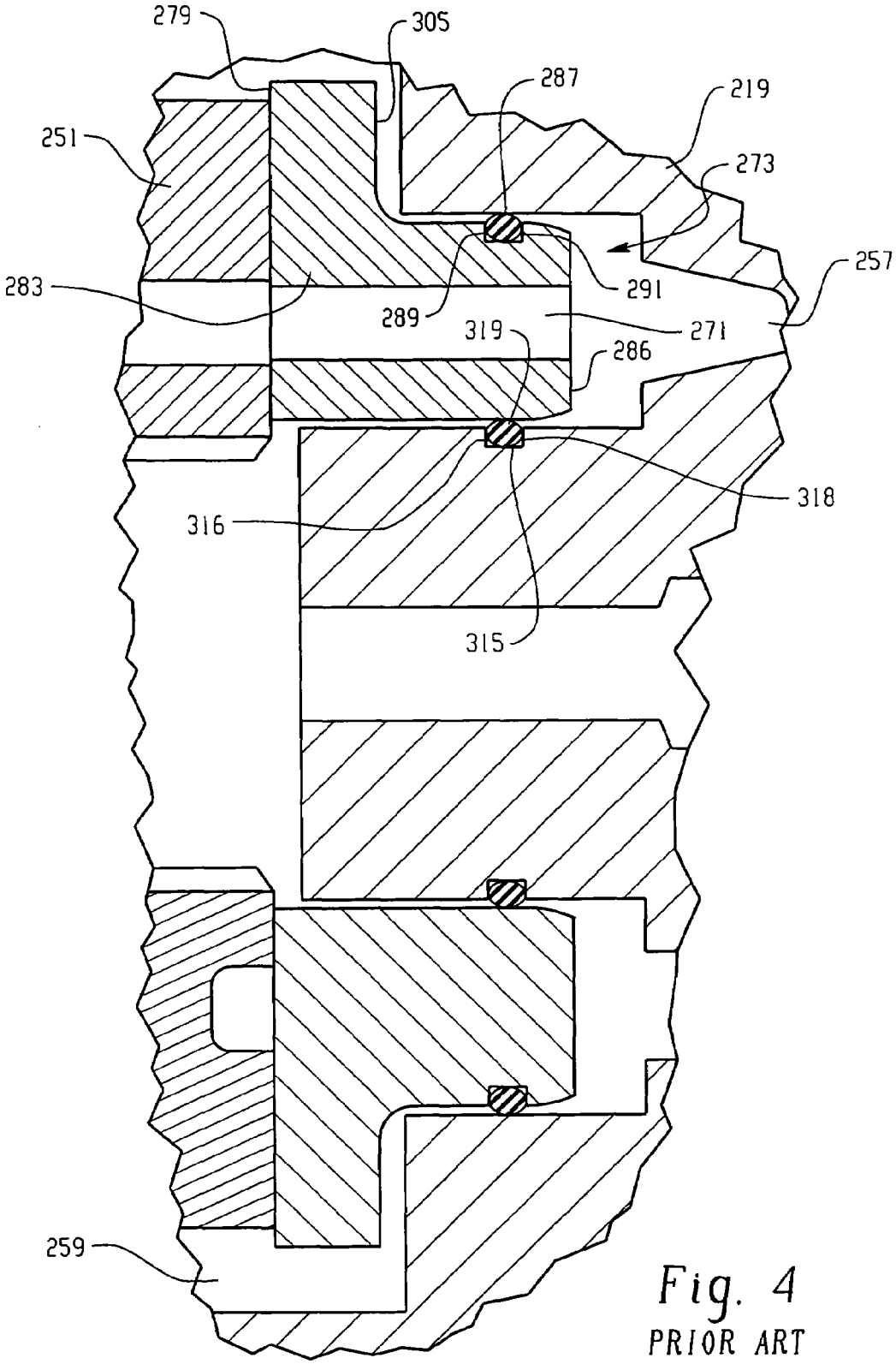
Fig. 4 PRIOR ART
FIG. 4 is a fragmentary axial cross-section of a prior art valve-seating mechanism.

FIG. 4 illustrates an embodiment ("PRIOR ART") of a prior art valve-seating mechanism 273. To the extent that elements associated with the prior art design are structurally or functionally equivalent to elements previously introduced in regards to the present invention, the reference numerals assigned to the prior art elements will bear the same reference numerals assigned to the elements of the present invention, plus "200". The prior art embodiment shown in FIG. 4 includes a valve housing 219, a rotatable valve member 251, and a prior art valve-seating mechanism 273. The valve housing 219 defines an annular fluid chamber 257 which is in fluid communication with a fluid port (not shown) and a valve housing cavity 259 which is in fluid communication with a second fluid port (not shown).

Referring still to FIG. 4, the prior art valve-seating mechanism 273 is a single piece structure which defines a valve confronting surface 279, a rearwardly projecting, integral ring portion 283, and an axial end surface 286. The rearwardly projecting, integral ring portion 283 defines a circumferential annular groove 287 disposed in the outer diameter of the integral ring portion 283 with a first axial end 289 and a second axial end 291. The prior art valve-seating mechanism 273 further defines a plurality of fluid passages 271 that extend from the axial end surface 286 through to the valve confronting surface 279.

Referring still to FIG. 4, the valve housing 219 defines a circumferential annular groove 315 which comprises a first axial end 316 and a second axial end 318. Disposed in the circumferential annular groove 315 is a sealing member 319 that prohibits the flow of fluid along the inner diameter of the prior art valve-seating mechanism 273.

Figure 5:
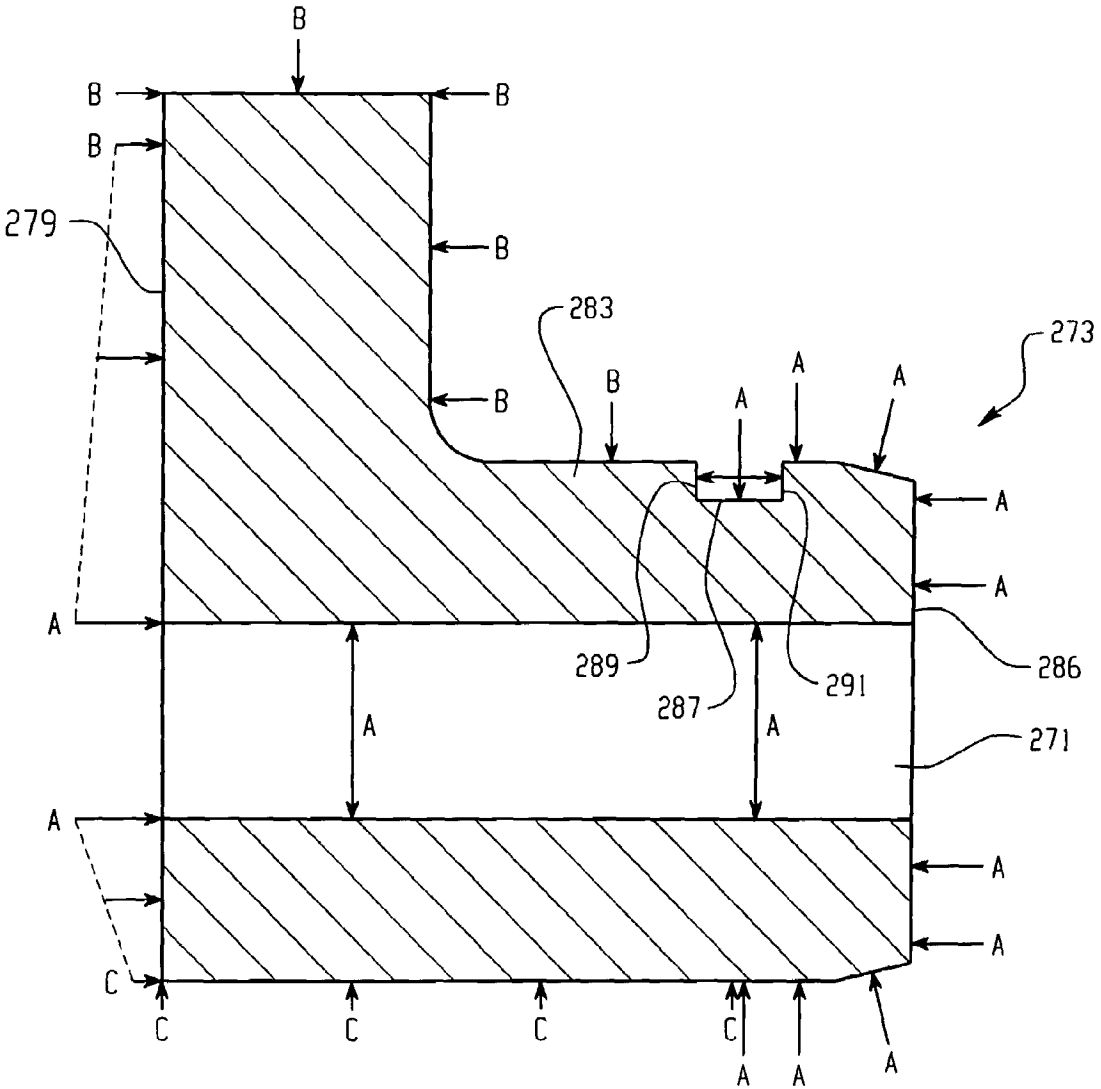
Fig. 5 PRIOR ART
FIG. 5 is a enlarged axial cross-section of the upper half of a prior art valve-seating mechanism illustrating applied pressure forces.

Referring now to FIG. 5, with reference to elements introduced in FIG. 4, the prior art valve-seating mechanism 273 is subjected to pressure forces from pressurized fluid. FIG. 5 illustrates these pressure forces acting on the prior art valve-seating mechanism 273 when inlet fluid flows through the annular fluid chamber 257 in the valve housing 219 and return fluid flows through the valve housing cavity 259. The inlet pressure forces acting on the prior art valve-seating mechanism 273 are designated with arrows accompanied by the letter "A" in FIG. 5. The return pressure forces acting on the prior art valve-seating mechanism 273, as illustrated in FIG. 5, result from pressurized return fluid in the valve housing cavity 259 which flows to the second fluid port (not shown) through the second fluid passage (not shown). The return pressure forces acting on the valve-seating mechanism 273 are designated using smaller arrows and the letter "B". Case pressure forces acting on the prior art valve-seating mechanism 273 are designated with small arrows accompanied by the letter "C".

Referring still to FIG. 5 with reference made to elements introduced in FIG. 4, inlet pressure forces "A" act on the inner diameter of the plurality of fluid passages 271 between the valve confronting surface 279 and the axial end surface 286. Inlet pressure forces "A" also act on the surfaces of the rearwardly projecting, integral ring portion 283 of the prior art valve-seating mechanism 273 from the first axial end 289 of the circumferential annular groove 287 over the entire surface of the axial end surface 286 of the prior art valve-seating mechanism 273. Inlet pressure forces "A" act on the surface of the inner diameter of the prior art valve-seating mechanism 273 from the axial end surface 286 to an axial location along the inner diameter of the valve-seating mechanism 273 where the inlet pressure forces "A" are approximately aligned with the first axial end 316 of the annular groove 315 in the valve housing 219.

Referring still to FIG. 5, return pressure forces "B" act on the outer diameter surfaces of the prior art valve-seating mechanism 273 between the valve confronting surface 279 and the first axial end 289 of the circumferential annular groove 287. The valve confronting surface 279 of the prior art valve-seating mechanism 273 is subjected to a pressure force gradient with inlet pressure force "A" located on a diameter surrounding the plurality of fluid passages 271 and return pressure force "B" at a location on the valve confronting surface 279 aligned with the outer diameter of the rotatable valve member 251. Return pressure force "B" acts on the valve confronting surface 279 between the location aligned with the outer diameter of the rotatable valve member 251 and the outer diameter of the valve confronting surface 279.

Referring still to FIG. 5, case pressure forces "C" act on the surface of the inner diameter of the prior art valve-seating mechanism 273 from the valve confronting surface 279 to the axial location along the inner diameter of the prior art valve-seating mechanism 273 where the case pressure forces "C" are approximately aligned with the first axial end 316 of the annular groove 315 in the valve housing 219. Case pressure and inlet pressure are maintained separate along the inner diameter of the prior art valve-seating mechanism 273 by the sealing member 319 which is disposed in the annular groove 315 in the valve housing 219.

Figure 6:
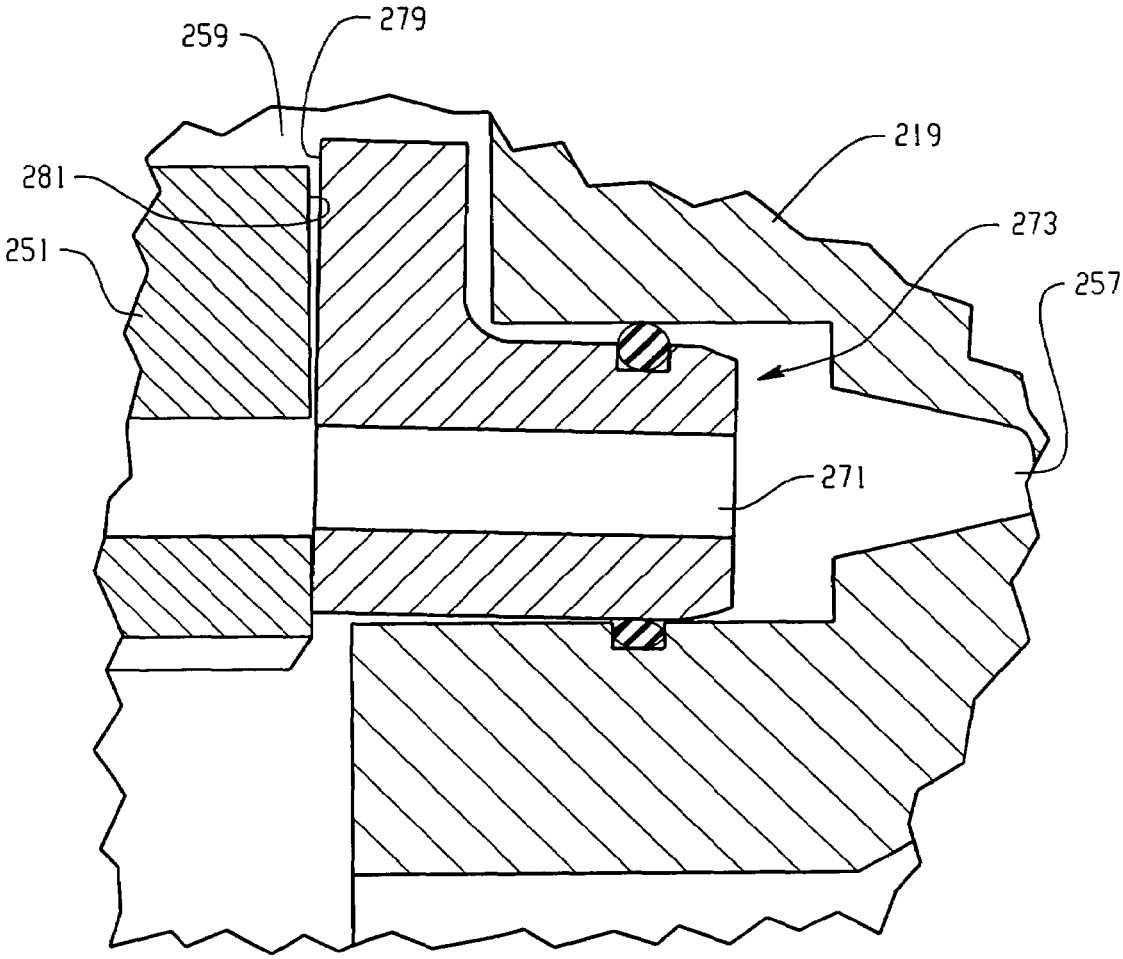
Fig. 6 PRIOR ART
FIG. 6 is a fragmentary axial cross-section of the upper half of a prior art valve-seating mechanism, illustrating resulting deflection from applied pressure forces.

FIG. 6 illustrates the distortion, as predicted by finite element analysis, of the prior art valve-seating mechanism 273 when the prior art valve-seating mechanism 273 is subjected to the previously described inlet, return and case pressure forces "A", "B", "C", respectively, as shown in FIG. 5. It should be understood by those skilled in the art that the relative amounts of distortion represented in FIG. 6 are greatly exaggerated, to facilitate illustration of the invention. As illustrated in FIG. 6, these pressure forces result in "potato chipping" of the prior art valve-seating mechanism 273, with a greater amount of deflection at the outer diameter of the valve confronting surface 279 than at the radially inner diameter of the valve confronting surface 279 of the prior art valve-seating mechanism 273. The inner diameter of the valve confronting surface 279 of the prior art valve-seating mechanism 273 maintains contact with the rearward surface 281 of the rotatable valve member 251, but the "potato chipping" of the prior art valve-seating mechanism 273 results in separation of the outer diameter of the valve confronting surface 279 of the prior art valve-seating mechanism 273 and the rearward surface 281 of the rotatable valve member 251. This separation allows for fluid communication between the plurality of fluid passages 271 in the prior art valve-seating mechanism 273 and the valve housing cavity 259. Since the fluid passages 271 are in open communication with the annular fluid chamber 257 in the valve housing 219, this separation then allows for an amount of fluid entering the motor through the fluid port, which is in open fluid communication with the annular fluid chamber 257, to flow to the second fluid port (not shown) which is in open fluid communication with the valve housing cavity 259, thereby bypassing the gerotor displacement unit 215. As discussed in the BACKGROUND OF THE INVENTION, the above-described "internal leakage" through the separation formed between the valve confronting surface 279 and the rearward surface 281 of the rotatable valve member 251 adversely affects the volumetric efficiency of the motor.

Figure 7:
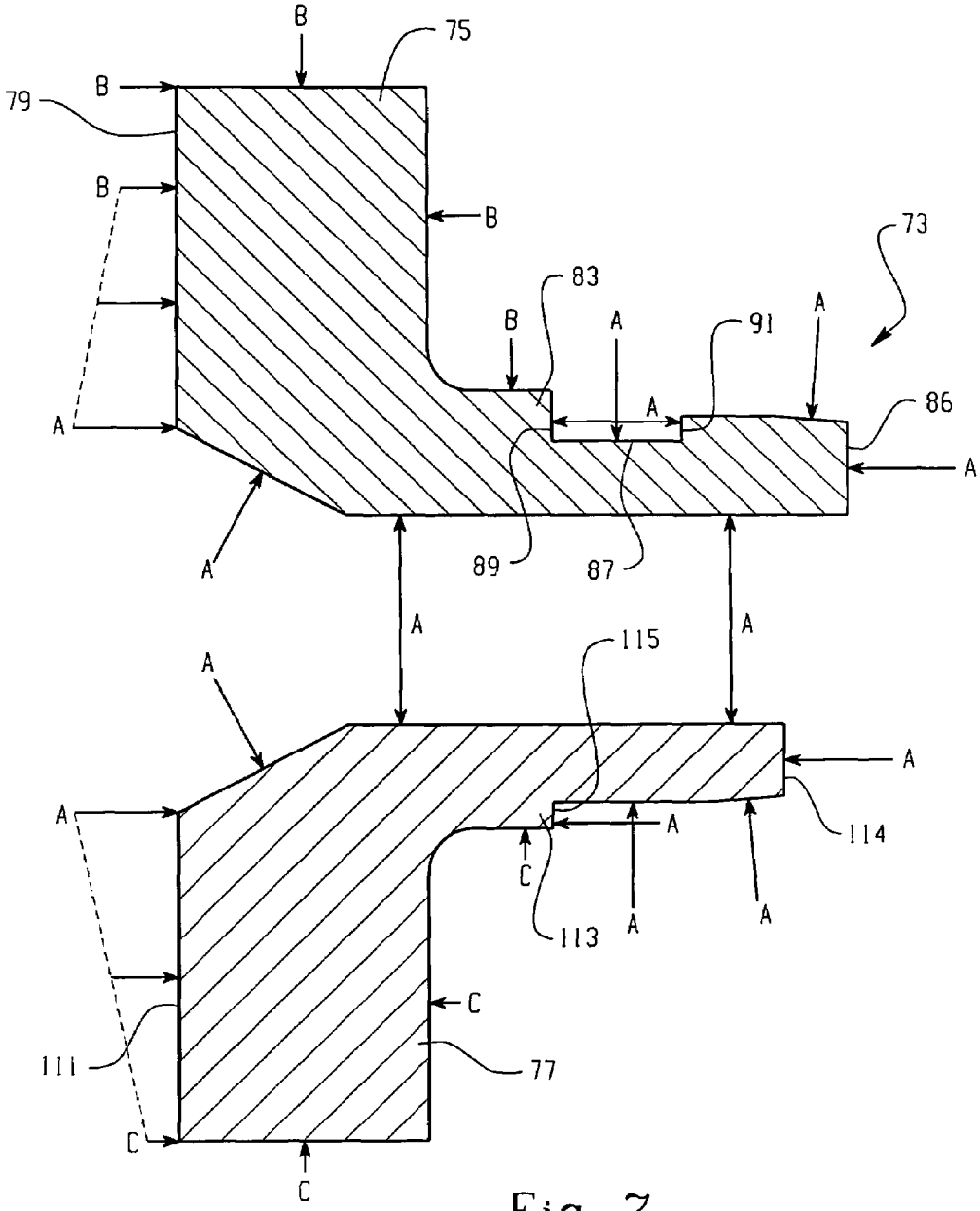
FIG. 7 is a fragmentary axial cross-section of the upper half of a valve-seating mechanism made in accordance with the present invention, illustrating applied pressure forces.

Referring now to FIG. 7 with reference made to elements introduced in FIGS. 1 and 2, the valve-seating mechanism 73 of the present invention is subjected to pressure forces from pressurized fluid in the disc-valve motor 11. FIG. 7 illustrates the pressure forces acting on the valve-seating mechanism 73 when inlet fluid flows from the fluid port 53 through the fluid passage 55 of the motor 11 and to the annular fluid chamber 57 in the valve housing 19. The inlet pressure forces acting on the valve-seating mechanism 73 are designated with arrows accompanied by the letter "A" in FIG. 7. The return fluid pressure forces acting on the valve-seating mechanism 73 in the motor 11, as illustrated in FIG. 7, result from pressurized return fluid in the valve housing cavity 59 which flows to the second fluid port (not shown) through the second fluid passage (not shown). The return pressure forces acting on the valve-seating mechanism 73 are designated by smaller arrows accompanied by the letter "B". Case pressure forces acting on the valve-seating mechanism 73 are designated with small arrows accompanied by the letter "C".

Referring still to FIG. 7, inlet pressure forces "A" act on the inner diameter of the outer balance ring member 75 between the valve confronting surface 79 and the axial end surface 86, as well as on the surfaces of the rearwardly projecting, integral ring portion 83 of the outer balance ring member 75 between and including the axial end surface 86 and the first axial end 89 of the circumferential annular groove 87. Return pressure forces "B" act on the outer diameter surfaces of the outer balance ring member 75 between the valve confronting surface 79 and the first axial end 89 of the circumferential annular groove 87. The valve confronting surface 79 of the outer balance ring member 75 is subjected to a pressure force gradient with inlet pressure force "A" at the inner diameter of the valve confronting surface 79 and return pressure force "B" acting at a location on the valve confronting surface 79 aligned with the outer diameter of the rotatable valve member 51, and with the forces gradually decreasing in the radially outward direction, as is represented by the arrows of decreasing length and the angled dashed line. Return pressure force "B" also acts on the valve confronting surface 79 between the location aligned with the outer diameter of the rotatable valve member 51 and the outer diameter of the outer balance ring member 75.

Referring still to FIG. 7, inlet pressure forces "A" act on the outer diameter surfaces of the inner balance ring member 77 between the valve confronting surface 111 and the axial end surface 114, as well as on the surfaces of the rearwardly projecting, integral ring portion 113 of the inner balance ring member 77 between and including the axial end surface 114 and the circumferential step 115. Case pressure forces "C" act on the inner diameter surfaces of the inner balance ring member 77 between the valve confronting surface 111 and the circumferential step 115. The valve confronting surface 111 of the inner balance ring member 77 is subjected to a pressure force gradient with inlet pressure force "A" acting on the outer diameter of the valve confronting surface 111 and case pressure force "C" acting on the inner diameter of the valve confronting surface 111. Again, the forces gradually decrease, but this time, in the radially inward direction, as is represented by the arrows of decreasing length and the angled dashed line.

Figure 8:
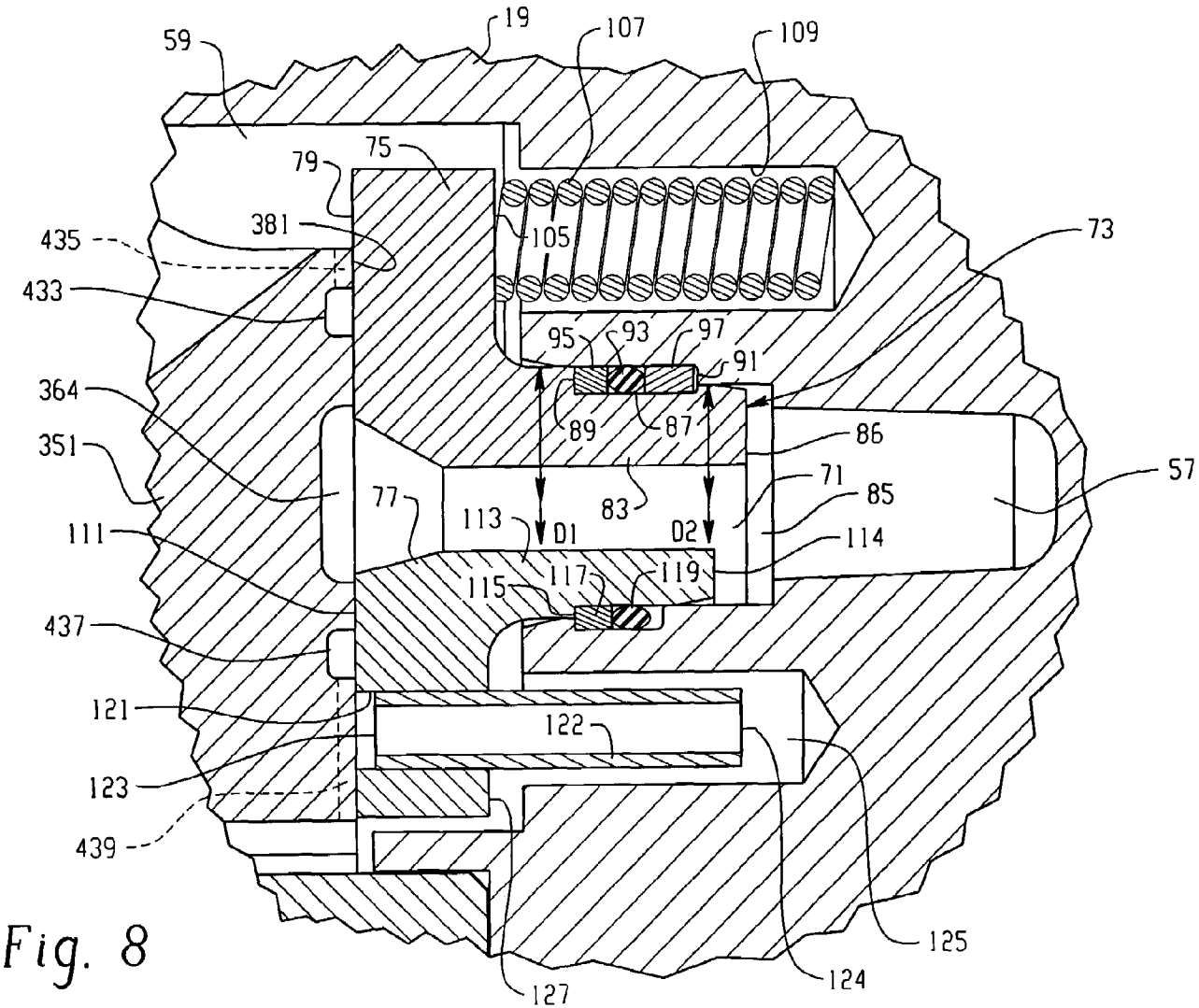
FIG. 8 is an enlarged, fragmentary, axial cross-section of an alternative embodiment of the interface between a rotatable valve member and a valve-seating mechanism, in accordance with the present invention.

Referring now to FIG. 8, an alternate embodiment of the interface between a rotatable valve member 351 and the valve-seating mechanism 73 is shown. To the extent that elements associated with the alternate embodiment of the interface between the rotatable valve member 351 and the valve-seating mechanism 73 are structurally or functionally equivalent to elements previously introduced, the reference numerals assigned to the alternate embodiment elements will bear the same reference numerals assigned to the elements of the subject embodiment, plus "300".

The rotatable valve member 351 defines an outer annular groove 433 disposed on a rearward surface 381 of the rotatable valve member 351 between the outer diameter of the rearward surface 381 and an annular fluid groove 364. The outer annular groove 433 is in open fluid communication with the cavity 59 in the valve housing 19 through a fluid passage 435 (shown in FIG. 8 with a dashed line and dashed lead line for the reference numeral). The rotatable valve member 351 further defines an inner annular groove 437 disposed on the rearward surface 381 between the inner diameter of the rearward surface 381 and the annular fluid groove 364. The inner annular groove 437 is in open fluid communication with the interior of the rotatable valve member 351 through a fluid passage 439 (shown in FIG. 8 with a dashed line and a dashed lead line for the reference numeral).

Figure 9:
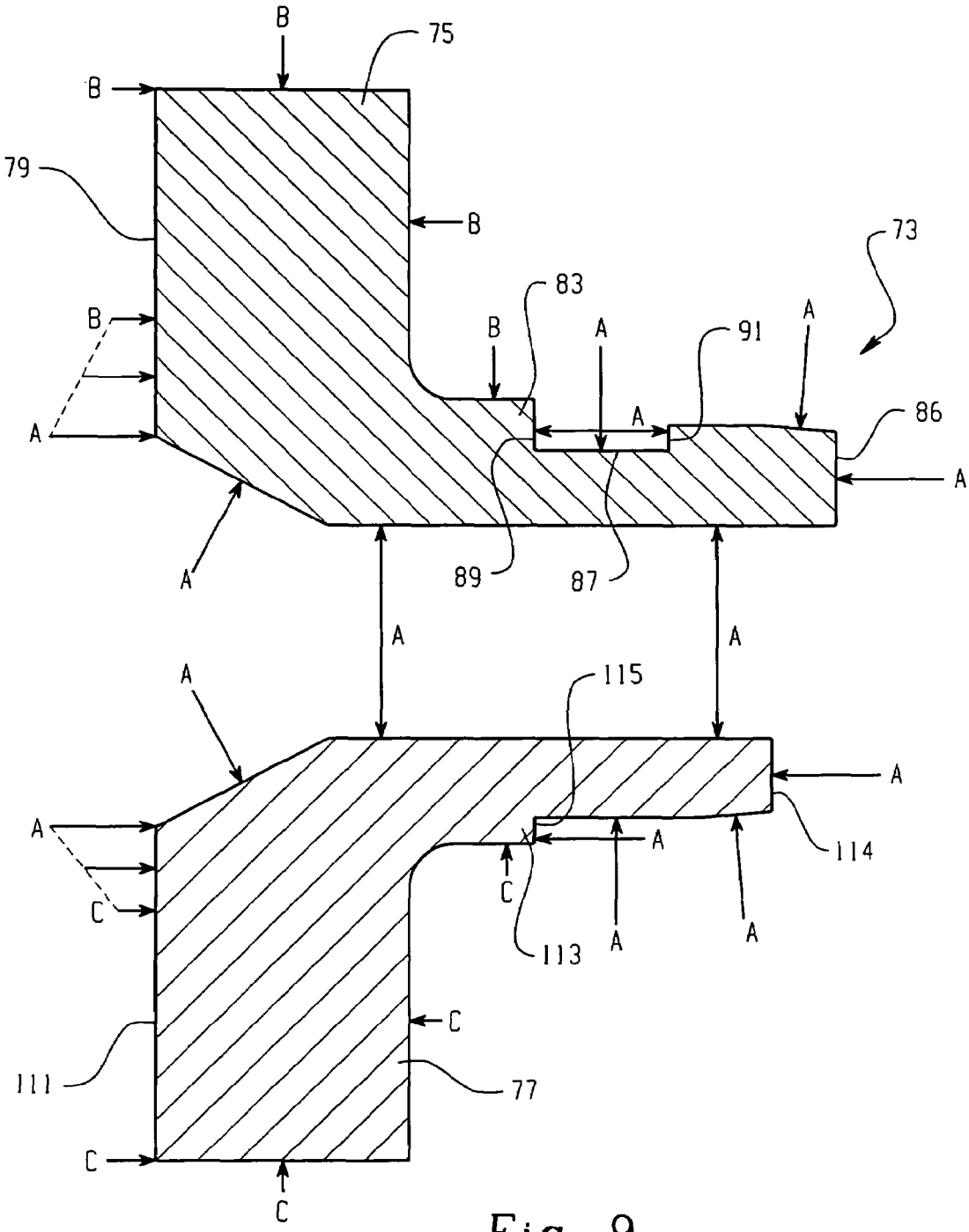
FIG. 9 is a fragmentary axial cross-section of the upper half of a valve-seating mechanism made in accordance with the present invention, illustrating applied pressure forces resulting from the alternate embodiment of the interface between a rotatable valve member and a valve-seating mechanism.

FIG. 9 illustrates the pressure forces acting on the valve-seating mechanism 73 resulting from the alternate embodiment of the interface between the rotatable valve member 351 and the valve-seating mechanism 73 when inlet fluid flows from the fluid port 53 through the fluid passage 55 of the motor 11 and to the annular fluid chamber 57 in the valve housing 19. The designations of the pressure forces used in FIG. 9 are the same as those used in FIGS. 5 and 7.

Referring still to FIG. 9, inlet pressure forces "A" act on the inner diameter of the outer balance ring member 75 between the valve confronting surface 79 and the axial end surface 86, as well as on the surfaces of the rearwardly projecting, integral ring portion 83 of the outer balance ring member 75 between and including the axial end surface 86 and the first axial end 89 of the circumferential annular groove 87. Return pressure forces "B" act on the outer diameter surfaces of the outer balance ring member 75 between the valve confronting surface 79 and the first axial end 89 of the circumferential annular groove 87. Since the outer annular groove 433 of the rotatable valve member 351 is in open fluid communication with the cavity 59, the pressure forces in the outer annular groove 433 would be substantially similar to the pressure forces in the cavity 59 of the valve housing 19, which in the present example would be return pressure force "B". The valve confronting surface 79 of the outer balance ring member 75 is subjected to a pressure force gradient with inlet pressure force "A" acting at the inner diameter of the valve confronting surface 79 and return pressure force "B" acting at the location on the valve confronting surface 79 approximately aligned with the inner diameter of the outer annular groove 433 in the rotatable valve member 351 with the forces gradually decreasing in the radially outward direction. This force gradient is represented in FIG. 9 by arrows decreasing in length and an angled dashed line. Since the pressure forces in the outer annular groove 433 are substantially equal to the pressure forces in the cavity 59 in the valve housing 19, return pressure force "B" would act on the valve confronting surface 79 from a location approximately aligned with the inner diameter of the outer annular groove 433 radially outward to the outer diameter of the valve confronting surface 79.

Referring still to FIG. 9, inlet pressure forces "A" act on the outer diameter surfaces of the inner balance ring member 77 between the valve confronting surface 111 and the axial end surface 114, as well as on the surfaces of the rearwardly projecting, integral ring portion 113 of the inner balance ring member 77 between and including the axial end surface 114 and the circumferential step 115. Case pressure forces "C" act on the inner diameter surfaces of the inner balance ring member 77 between the valve confronting surface 111 and the circumferential step 115. Since the inner annular groove 437 of the rotatable valve member 351 is in open fluid communication with the interior of the rotatable valve member 351, the pressure forces in the inner annular groove 437 would be substantially similar to the pressure forces in the interior of the rotatable valve member 351, which in the present example would be case pressure forces "C". Therefore, the valve confronting surface 111 of the inner balance ring member 77 is subjected to a pressure force gradient with inlet pressure force "A" acting at the outer diameter of the valve confronting surface 111 and case pressure force "C" acting at the location on the valve confronting surface 111 approximately aligned with the outer diameter of the inner annular groove 437 in the rotatable valve member 351. Again, the forces gradually decrease, but this time, in the radially inward direction, as is represented by arrows of decreasing length and an angled dashed line. Since the pressure forces in the inner annular groove 437 are substantially equal to the pressure forces in the interior of the rotatable valve member 351, case pressure force "C" would act on the valve confronting surface 111 from a location approximately aligned with the outer diameter of the inner annular groove 437 radially inward to the inner diameter of the valve confronting surface 111.

Figure 10:
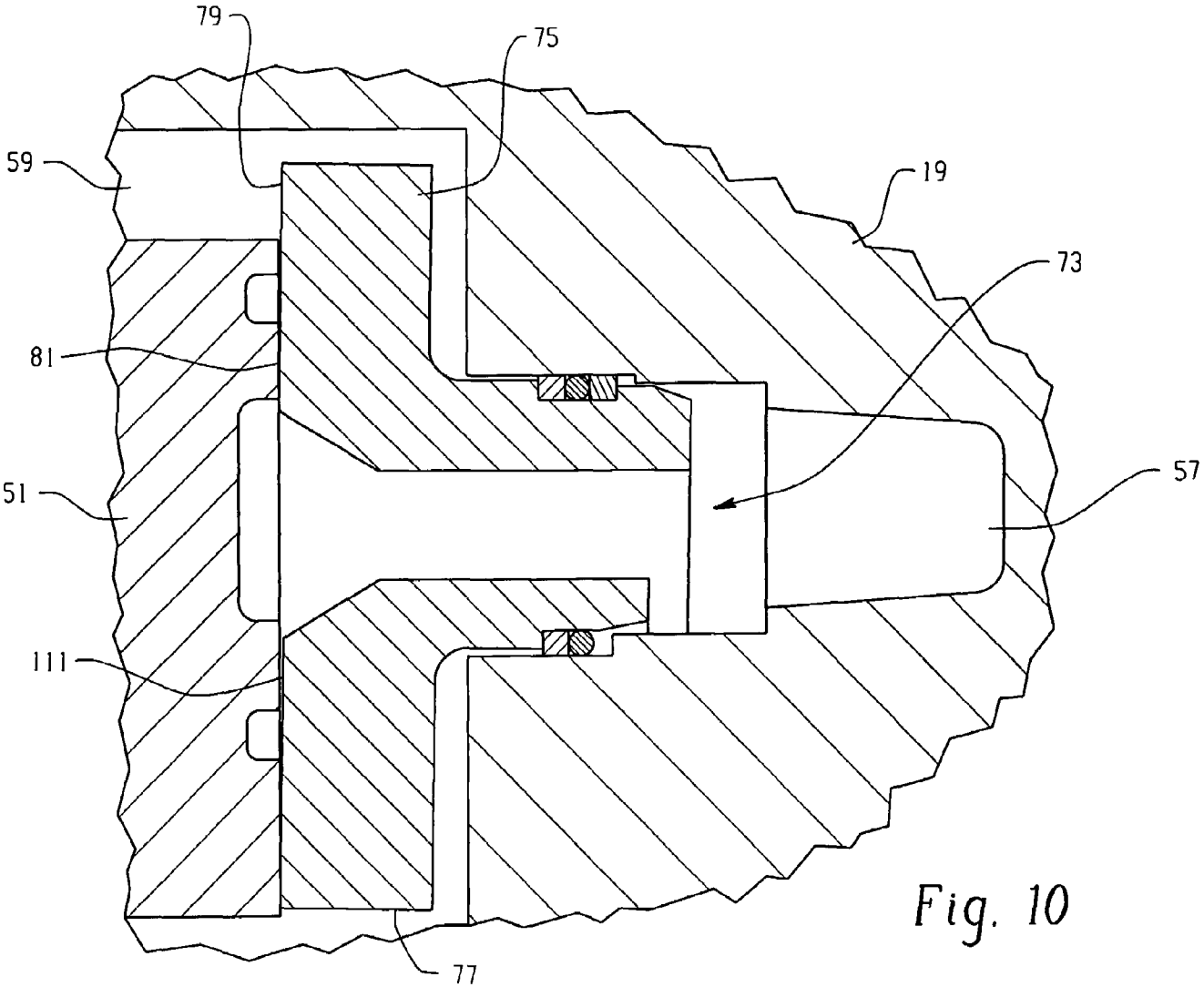
FIG. 10 is an enlarged, fragmentary axial cross-section, including the upper half of a valve-seating mechanism made in accordance with the present invention, illustrating the resulting deflection from applied pressure forces.

FIG. 10 illustrates the distortion, deformation, or deflection, as predicted by finite element analysis, of the present invention when the valve-seating mechanism 73 is subjected to the previously defined inlet, return and case pressure forces "A", "B", "C", respectively, shown in FIGS. 7 and 9. It should be understood by those skilled in the art that the relative amounts of distortion represented in FIG. 10 are greatly exaggerated, to facilitate illustration of the invention. In the present invention, both the outer balance ring member 75 and the inner balance ring member 77 are subjected to a "potato chipping" effect resulting from the previously defined pressure forces. However, the "potato chipping" effect of the outer balance ring member 75 and the inner balance ring member 77 is substantially less than the "potato chipping" effect of the prior art valve-seating mechanism 273. As shown in FIG. 10, the inner diameter of the valve confronting surface 111 of the inner balance ring member 77 maintains contact with the rearward surface 81 of the rotatable valve member 51. But, the deflection of the inner balance ring member 77 results in separation of the outer diameter of the valve confronting surface 111 of the inner balance ring member 77 and the rearward surface 81 of the rotatable valve member 51.

Referring still to FIG. 10, the deflection of the outer balance ring member 75 results in separation of the outer diameter of the valve confronting surface 79 of the outer balance ring member 75 and the rearward surface 81 of the rotatable valve member 51. But the inner diameter of the valve confronting surface 79 of the outer balance ring member 75 maintains contact with the rearward surface 81 of the rotatable valve member 51. Therefore, unlike the prior art valve-seating mechanism 273, the outer balance ring member 75 maintains sealing engagement with the rearward surface 81 of the rotatable valve member 51 between the fluid passage 71 and the valve housing cavity 59. Thus, the amount of leakage resulting from the deformation of the valve-seating mechanism 73 is significantly reduced as compared to the leakage resulting from the deformation of the prior art valve-seating mechanism 273.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A rotary fluid pressure device of the type having a housing means defining a fluid inlet and a fluid outlet, a fluid energy-translating displacement means defining expanding and contracting fluid volume chambers, a stationary valve member defining fluid passages in communication with said expanding and contracting fluid volume chambers and having a valve surface, a rotary valve member defining valve passages providing commutating fluid communication between said fluid inlet and said fluid outlet and said fluid passages and having a valve surface in sliding, sealing engagement with said valve surface of said stationary valve member, said rotary valve member further having an opposite surface; characterized by:

(a) an outer balance ring member having a valve-confronting surface in engagement with said opposite surface;

(b) an inner balance ring member having a valve-confronting surface in engagement with said opposite surface, wherein the inner balance ring member includes a retainer member preventing rotation of said inner balance ring member relative to said rotary valve member; and (c) said outer balance ring member and said inner balance ring member cooperating to define a fluid passage for providing fluid communication between one of said fluid inlet and said fluid outlet and said valve passages.

2. A rotary fluid pressure device as claimed in claim 1, characterized by said outer balance ring member including a retainer member for preventing rotation of said outer balance ring member relative to said rotary valve member.

3. A rotary fluid pressure device as claimed in claim 2, characterized by a pin member inserted in a rotational constraint hole of said outer balance ring and a rotational constraint hole of said housing means for preventing rotation of said outer balance ring member relative to said rotary valve member.

4. A rotary fluid pressure device as claimed in claim 1, characterized by a pin member inserted in a rotational constraint hole of said inner balance ring and a rotational constraint hole of said housing means for preventing rotation of said inner balance ring member relative to said rotary valve member.

5. A rotary fluid pressure device as claimed in claim 1, characterized by said outer balance ring member defining an annular groove with a first axial end having an outer diameter D1 and a second axial end having an outer diameter D2, wherein diameter D1 of said first axial end of said annular groove is larger than diameter D2 of said second axial end of said annular groove.

6. A rotary fluid pressure device of the type having a housing means defining a fluid inlet and a fluid outlet, a fluid energy-translating displacement means defining expanding and contracting fluid volume chambers, a stationary valve member defining fluid passages in communication with said expanding and contracting fluid volume chambers and having a valve surface, a rotary valve member defining valve passages providing commutating fluid communication between said fluid inlet and said fluid outlet and said fluid passages and having a valve surface in sliding, sealing engagement with said valve surface of said stationary valve member, said rotary valve member further having an opposite surface; characterized by:

(a) an outer balance ring member having a valve-confronting surface in engagement with said opposite surface, said outer balance ring member defining an annular groove with a first axial end having an outer diameter D1 and a second axial end having an outer diameter D2, wherein diameter D1 of said first axial end of said annular groove being larger than diameter D2 of said second axial end of said annular groove;

(b) an inner balance ring member having a valve-confronting surface in engagement with said opposite surface; and (c) said outer balance ring member and said inner balance ring member cooperating to define a fluid passage for providing fluid communication between one of said fluid inlet and said fluid outlet and said valve passages.

7. A rotary fluid pressure device as claimed in claim 6, characterized by a sealing member disposed within said annular groove in the outer balance ring member.

8. A valve seating mechanism for a rotary fluid pressure device of a disc-valve type, the valve seating mechanism comprising:

an outer balance ring member having a valve-confronting surface adapted for engagement with a surface of a rotary valve member, said outer balance ring member defining an annular groove with a first axial end having an outer diameter D1 and a second axial end having an outer diameter D2, wherein diameter D1 of said first axial end of said annular groove is larger than diameter D2 of said second axial end of said annular groove; and an inner balance ring member having a valve-confronting surface adapted for engagement with said surface of said rotary valve member, wherein said outer balance ring member and said inner balance ring member cooperate to define a fluid passage.

9. A valve seating mechanism for a rotary fluid pressure device of a disc-valve type as claimed in claim 8, further comprising a sealing member disposed in said annular groove in said outer balance ring member.

10. A valve seating mechanism for a rotary fluid pressure device of a disc-valve type as claimed in claim 8, wherein the inner balance ring member includes a retainer member adapted to prevent rotation of said inner balance ring member relative to said rotary valve member.

11. A valve seating mechanism for a rotary fluid pressure device of a disc-valve type as claimed in claim 10, wherein said retainer member of said inner balance ring member is a pin member.

12. A valve seating mechanism for a rotary fluid pressure device of a disc-valve type as claimed in claim 10, wherein said outer balance ring member includes a retainer member adapted to prevent rotation of said outer balance ring member relative to said rotary valve member.

13. A valve seating mechanism for a rotary fluid pressure device of a disc-valve type as claimed in claim 12, wherein said retainer member of said outer balance ring member is a pin member.

* * * * *